US008708217B2

(12) United States Patent
Boukredine

(10) Patent No.: US 8,708,217 B2
(45) Date of Patent: Apr. 29, 2014

(54) CARTON AND CARTON BLANK

(75) Inventor: Eric Boukredine, Ambrault (FR)

(73) Assignee: MeadWestvaco Packaging Systems, LLC, Richmond, VA (US)

( * ) Notice: Subject to any disclaimer, the term of this patent is extended or adjusted under 35 U.S.C. 154(b) by 637 days.

(21) Appl. No.: 12/743,216

(22) PCT Filed: Nov. 14, 2008

(86) PCT No.: PCT/US2008/083593

§ 371 (c)(1),
(2), (4) Date: Mar. 24, 2011

(87) PCT Pub. No.: WO2009/065011

PCT Pub. Date: May 22, 2009

(65) Prior Publication Data

US 2011/0284622 A1 Nov. 24, 2011

(30) Foreign Application Priority Data

Nov. 15, 2007 (GB) ..... 0722417.3

(51) Int. Cl.
*B65D 5/06* (2006.01)

(52) U.S. Cl.
USPC ..... 229/103.2; 206/427

(58) Field of Classification Search
USPC ..... 206/427, 140, 155–156; 229/103.2
See application file for complete search history.

(56) References Cited

U.S. PATENT DOCUMENTS

| | | | | |
|---|---|---|---|---|
| D259,104 | S | 5/1981 | Calvert | |
| 4,295,562 | A * | 10/1981 | Wood | 206/158 |
| 5,000,313 | A | 3/1991 | Oliff | |
| 5,197,598 | A * | 3/1993 | Stout et al. | 206/141 |
| 5,246,112 | A * | 9/1993 | Stout et al. | 206/427 |
| 5,328,081 | A | 7/1994 | Saulas | |
| 2004/0000494 | A1 | 1/2004 | Sutherland | |
| 2006/0169755 | A1 * | 8/2006 | Spivey, Sr. | 229/117.16 |
| 2006/0266812 | A1 * | 11/2006 | Von Bokel | 229/117.14 |

FOREIGN PATENT DOCUMENTS

| | | |
|---|---|---|
| DE | 9309238 | 8/1993 |
| EP | 0446042 | 9/1991 |

* cited by examiner

*Primary Examiner* — Gary Elkins
*Assistant Examiner* — Scott McNurlen
(74) *Attorney, Agent, or Firm* — MWV Intellectual Property Group

(57) ABSTRACT

A carton for packaging a plurality of articles includes top (214, 314) and bottom (218/220, 318/320) panels connected together by spaced side wall panels thereby forming a tubular structure and a set of end panels for at least partially closing each end of the tubular structure. Each set of end panels includes a pair of upper end closure panels (232*a*, 232*b*, 332*a*, 332*b*), a pair of lower end closure panels (226*a*, 226*b*, 326*a*, 326*b*) hinged to respective lower portions of the side wall panels respectively and a pair of securing panels (224*a*, 224*b*, 324*a*, 324*b*) hingedly connected to respective upper portions of the side wall panels respectively. The upper end closure panels (232*a*, 232*b*, 332*a*, 332*b*) are hingedly connected respectively to the securing panels by respective connecting panels (230*a*, 230*b*, 340*a*, 340*b*). The upper end closure panels are coupled to the lower end closure panels respectively.

10 Claims, 12 Drawing Sheets

CARTON AND CARTON BLANK

FIELD OF THE INVENTION

The present invention relates to a carton and blank for forming the same. More specifically but not exclusively to a carton having a substantially tubular structure, said carton being of the wraparound type and optionally having means for automatically folding an end panel so as to at least partially close an end of the tubular structure.

BACKGROUND OF THE INVENTION

Wraparound type carton blanks typically comprise plurality of panels foldably hinged to each other for forming top, base and side walls. It is also known to provide an end closure structure of at least partially closing the end of the wraparound carton such a carton is shown in EP 0446042 to Bakx.

It is desirable to increase the security of the articles within the carton to prevent theft of the articles from the carton. It is also desirable to provide means for carrying a package.

SUMMARY OF INVENTION

According to a first aspect, the invention provides a carton for packaging a plurality of articles comprising top and bottom panels connected together by spaced side wall panels thereby forming a tubular structure and a set of end panels for at least partially closing each end of the tubular structure, each of said sets of end panels comprising a pair of upper end closure panels, a pair of lower end closure panels hinged to respective lower portions of the side wall panels respectively and a pair of securing panels hingedly connected to respective upper portions of said side wall panels respectively, said upper end closure panels being hingedly connected respectively to said securing panels by respective connecting panels, said upper end closure panels being coupled to the lower end closure panels respectively.

Preferably, the upper end closure panels are coupled respectively to the securing panels by respective frangible connections.

Optionally, the upper end closure panels are coupled respectively to the lower end closure panels by the respective connecting panels. Preferably, said upper end closure panels are coupled directly to the lower end closure panels respectively along fold lines.

Preferably, there further comprises a top end flap hinged to said top panel and secured to said upper end closure panels. Optionally, that top end flap is coupled to each of the securing panels by web panels.

Preferably, the top end flap comprises upper and lower portions hingedly connected together by a fold line to facilitate application of adhesive to said upper end closure panels.

According to a second aspect, the invention provides a blank for forming a carton for packaging a plurality of articles, the blank comprising top and bottom panels connected together by spaced side wall panels formable into a tubular structure and a set of end panels for at least partially closing each end of the tubular structure, each of said sets of end panels comprising a pair of upper end closure panels, a pair of lower end closure panels hinged to respective lower portions of the side wall panels respectively and a pair of securing panels hingedly connected to respective upper portions of said side wall panels respectively, said upper end closure panels being hingedly connected respectively to said securing panels by respective connecting panels, said upper end closure panels being coupled to the lower end closure panels respectively.

A further aspect of the invention provides a blank for forming a carton, which blank comprises a series of panels for forming a top panel, a bottom panel and a pair of side wall panels of a carton, and a set of end panels, each of said sets of end panels comprising a lower end closure panel hinged to a respective one of said side wall panels and a securing panel hinged to said respective side wall panel and an upper end closure panel coupled to the lower end closure panel, wherein said upper end closure panel and said securing panel are each struck from material provided in an area defined by boundaries of the lower end closure panel, the respective side wall panel and a top end flap hinged to said top panel.

Preferably, the upper end closure panel is coupled to the securing panel by a frangible connection.

Optionally, the upper end closure panel is coupled to the lower end closure panel by a connecting panel. Preferably, the upper end closure panel is coupled directly to the lower end closure panel along a fold line.

Optionally, there further comprises a top end flap hinged to said top panel to be secured to said upper end closure panel when the blank is erected into a carton. Preferably, the top end flap is coupled to the securing panel by a web panel.

Optionally, the top end flap comprises upper and lower portions hingedly connected together by a fold line to facilitate application of adhesive to said upper end closure panel.

BRIEF DESCRIPTION OF THE DRAWINGS

Exemplary embodiments of the invention will now be described with reference to the accompanying drawings in which.

DETAILED DESCRIPTION OF EXEMPLARY EMBODIMENTS OF THE PRESENT INVENTION

Figure 1:
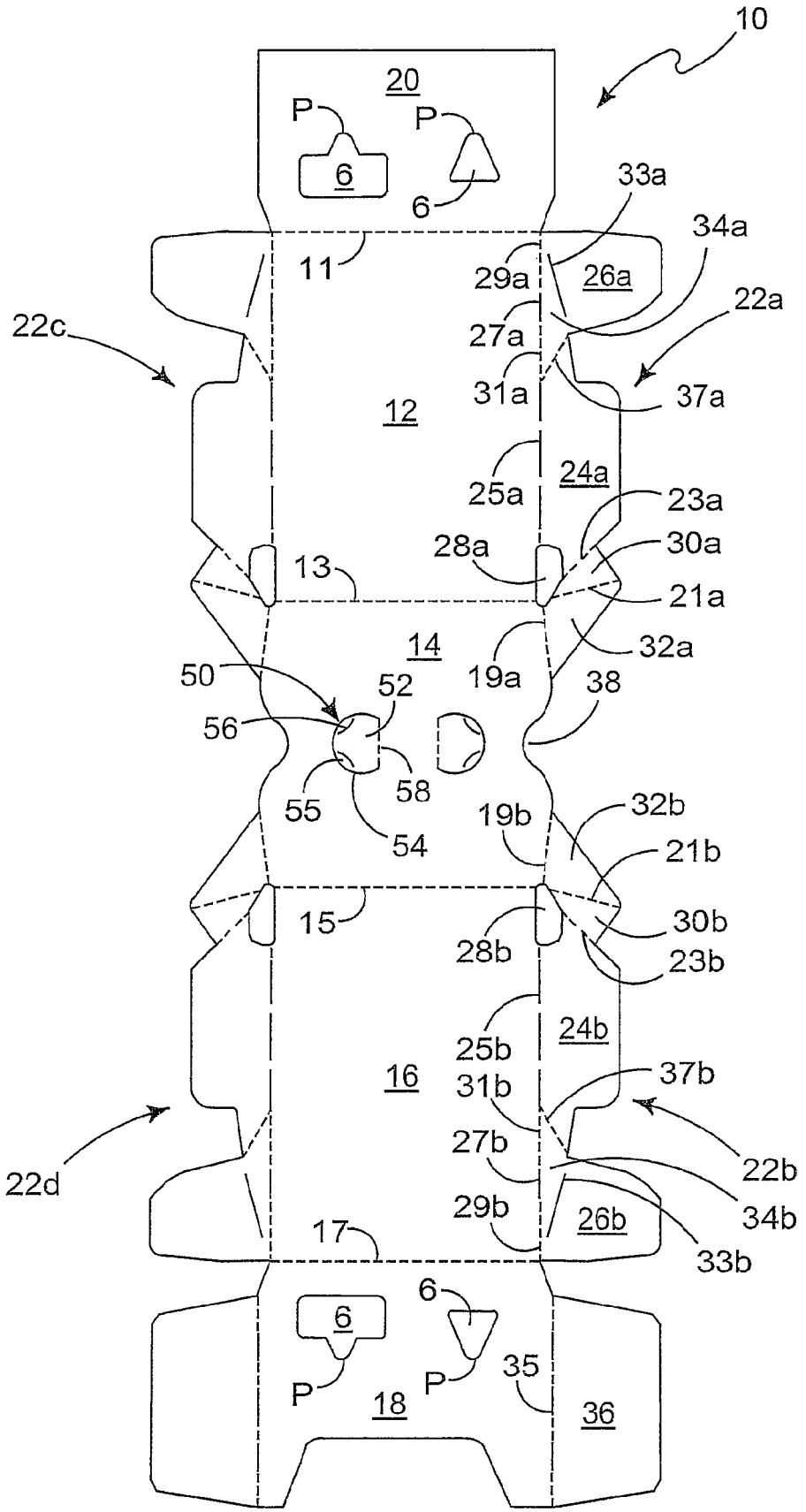
FIG. 1 shows a plan view of a blank for forming a carton according to a first embodiment of the present invention.

FIG. 1 shows a blank 10 for forming a carton 70 which blank 10 comprises a plurality of panels 12, 14, 16, 18, 20 for forming a base wall 18, 20 a pair of opposed side walls 12, 16 and a top wall 14.

The plurality of panels 12, 14, 16, 18, 20 are folded about a group of articles A to form said top wall 14, opposed side walls 12, 16 and base wall 18, 20.

Panels 18 and 20 overlap to form a composite base wall 18 and 20 may be secured together using mechanical locking means or adhesive securing means known in the art.

Panels 18 and 20 each comprise a pair of apertures 6 which comprise a point P. The apertures 6 can be engaged either manual or automatically to facilitate securing the carton and for tightening the carton about a group of articles A.

Each opposed side wall 12, 16 comprises two pairs of end closure structures 22*a*, 22*b*; 22*c*, 22*d*. End closure structures 22*a*, 22*b*, 22*c*, and 22*d* are substantially the same in construction; therefore only one pair of end closure structure 22*a*, 22*b* will be described in detail.

Each end closure structure 22*a*, 22*b* comprises a securing panel 24*a*, 24*b* hinged to a respective one of the opposed side walls 12, 16 along fold lines 25*a*, 25*b* respectively. A top end flap 32*a*, 32*b* is hinged to a top panel 14 along fold lines 19*a*, 19*b* respectively. The top end flaps 32*a*, 32*b* are hinged to gusset panels 30*a*, 30*b* along fold lines 21*a*, 22*b* respectively. Gusset panels 30*a*, 30*b* are in turn hinged to securing panels 24*a*, 24*b* along fold lines 23*a*, 23*b* respectively. Gusset panels 30*a*, 30*b* interconnect top end flaps 32*a*, 32*b* and securing panels 24*a*, 24*b* respectively.

Apertures 28*a*, 28*b* are struck from; top panel 14, a respective one of opposed side panels 12, 16 and respective ones of top end flaps 32*a*, 32*b* gusset panels 30*a*, 30*b* and securing panels 24*a*, 24*b*. Apertures 28*a*, 28*b* facilitate folding of the end closure structures 22*a*, 22*b*. Web panels 34*a*, 34*b* are hinged to securing panel 24*a*, 24*b* respectively along fold lines 37*a*, 37*b*.

Web panels 34*a*, 34*b* are also coupled to a respective one of opposed side panels 12, 16 by a pair of fold lines 29*a*, 29*b*, 31*a*, 31*b*. Fold lines 29*a*, 29*b* are separated from fold lines 31*a*, 31*b* by cut lines 27*a*, 27*b* respectively. Web panels 34*a*, 34*b* are further defined, in part, by cut lines 33*a*, 33*b*. Cut lines 33*a*, 33*b* each define a respective boundary between a respective one of web panels 34*a*, 34*b* and corresponding respective one of end closure panels 26*a*, 26*b*.

Top panel 14 comprises a handle having finger engaging portions 150. Finger engaging portion 150 comprises a cut line 154 which is arcuate in nature. Each end of cut line 154 is adjacent to a fold line 158, hingedly connected therebetween. Cut line 154 and fold line 158 define a flap panel 152. Flap panel 152 is displaceable from a plane defined by top panel 14. Flap panel 152 comprises a pair of arcuate cut lines 156 disposed about an edge of cut line 154 substantially opposing fold line 158. Cut lines 156 and cut line 154 define in part a pair of tabs 155. Tabs 155 facilitate displacement of flap panels 153 into the assembled carton, by deflecting that of the plane of flap panel 152 alternatively when tabs 155 are forced past articles A. A bottom end flap 36 is hinged to bottom panel 18 along fold line 35.

Figure 2:
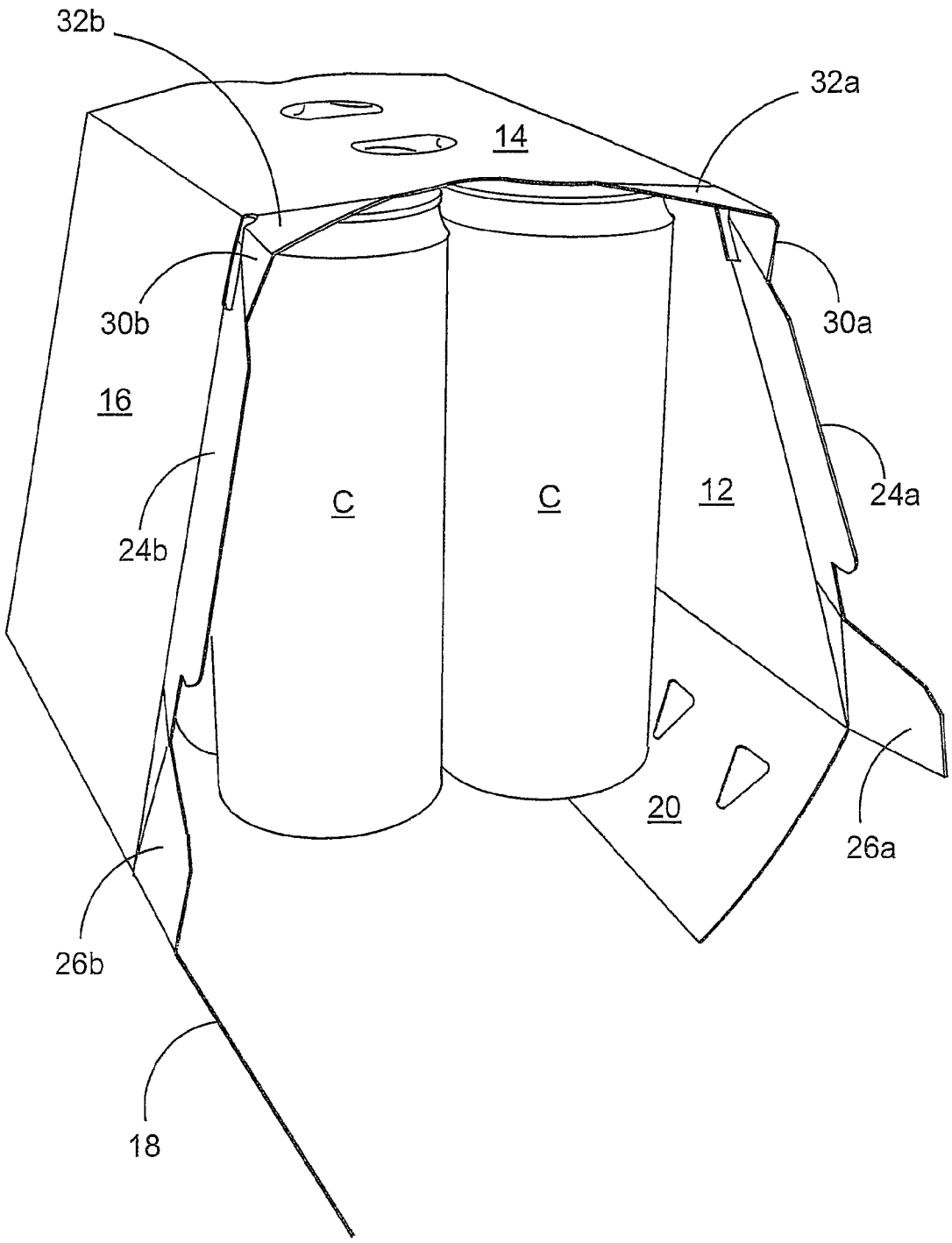
FIG. 2 illustrates a perspective view of the blank of FIG. 1 partially assembled about a group of articles.

Turning now to FIGS. 2 to 5, which illustrate assembly of the blank 10 into a carton 90; FIG. 2 illustrates blank 10, partially folded about a group of articles A. Top panel 14 is placed upon the group of articles A. Opposed side walls 12, 16 are folded about the group of articles A along fold lines 13, 15 respectively.

Figure 3:
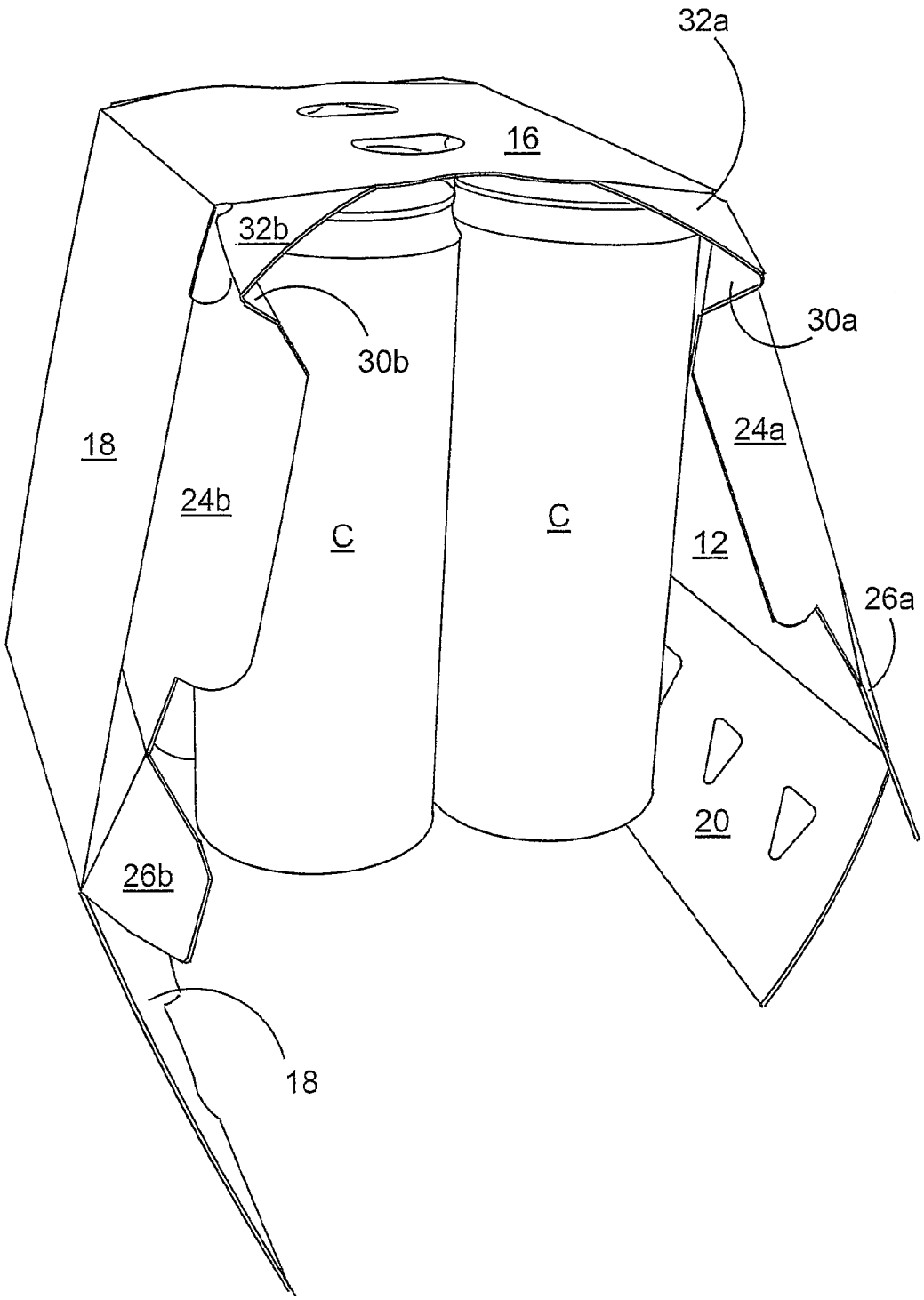
FIG. 3 illustrates a perspective view of a further stage of assembly of the blank of FIG. 1 about a group of articles.

FIG. 3 illustrates securing panels 24*a*, 24*b* being folded inwardly, whilst top end flaps 32*a*, 32*b* are folded downwardly. Gusset panels 30*a*, 30*b* are being folded between top end flaps 32*a*, 32*b* and securing panels 24*a*, 24*b*.

Figure 4:
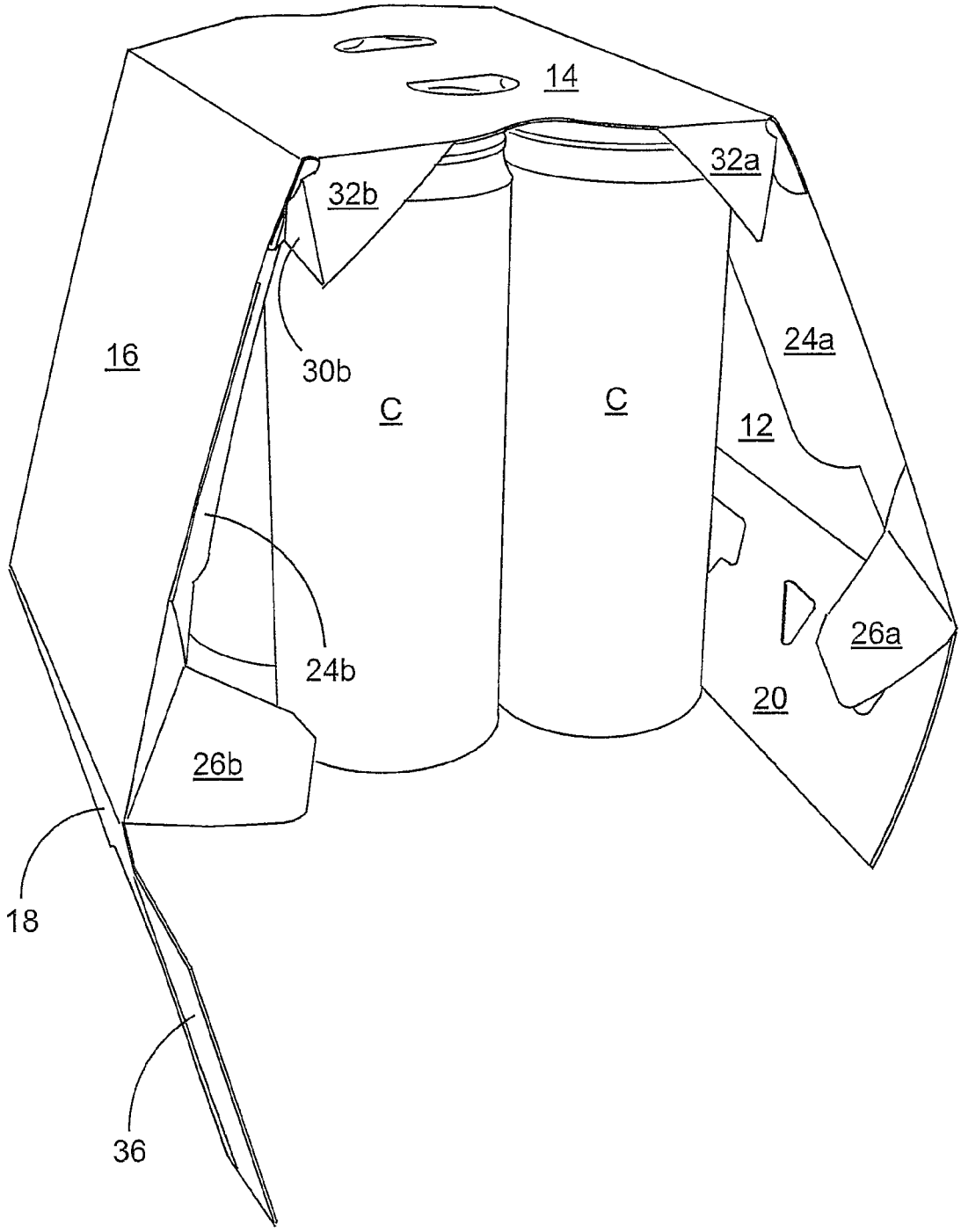
FIG. 4 illustrates a perspective view of a still further stage of assembly of the blank of FIG. 1 about a group of articles.

FIG. 4 illustrates securing panels 24*a*, 24*b* being folded between one of the respective opposed side walls 12, 16 to which it is hinged and an article adjacent that respective opposed side walls 12, 16.

In this way the article A anchors the respective securing panel 12, 16 in place. Top end flaps 32*a* and 32*b* have been folded substantially perpendicular with the top panel 14 whereby preventing dislodgement of the article from the top of the carton 90.

Furthermore, by virtue of the provision of web panels 34*a*, 34*b* and the angled configuration of fold lines 37*a*, 37*b* and cut lines 33*a*, 33*b* end closure panels 26*a*, 26*b* remain substantially perpendicular to opposed side walls 12, 16 whereas securing panels 24*a*, 24*b* are folded substantially 180° about fold line 25*a*, 25*b* such that they are in flat face contacting relationship with a respective one of opposed side wall panel 12, 16.

Figure 5:
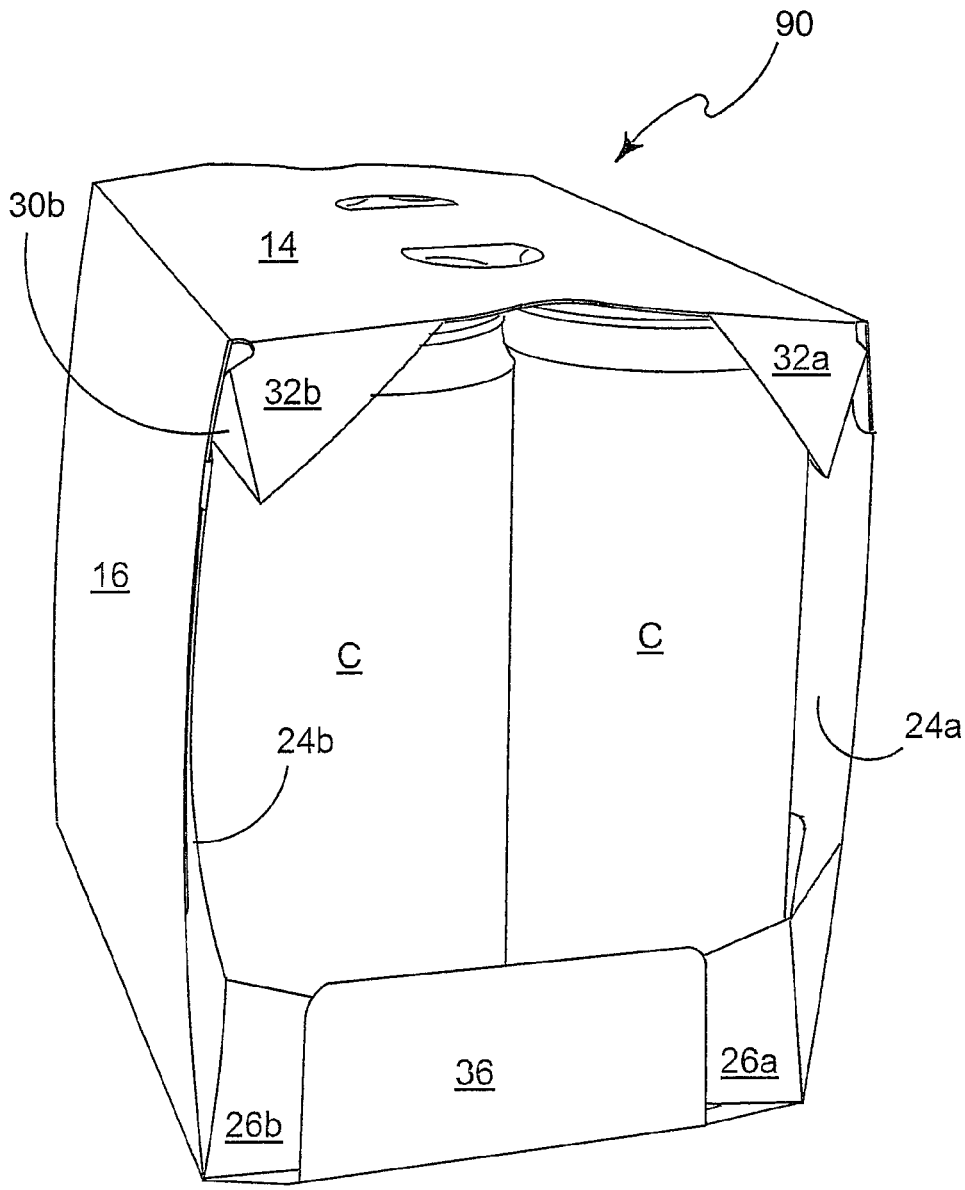
FIG. 5 illustrates a perspective view of an assembled carton according to a first embodiment of the present invention.

Turning now to FIG. 5, it can be seen that bottom end flap 36 has been secured to each of end closure panels 26*a*, 26*b*. In the preferred embodiment it is envisaged that this securing will be achieved using adhesive. The adhesive is applied to an inside surface of the bottom end flap 36 in an inline gluing process either manually or automatically however, in alternative embodiments it is envisaged that the adhesive could be applied to an outer surface of each of the end closure panels 26*a*, 26*b*.

Figure 6:
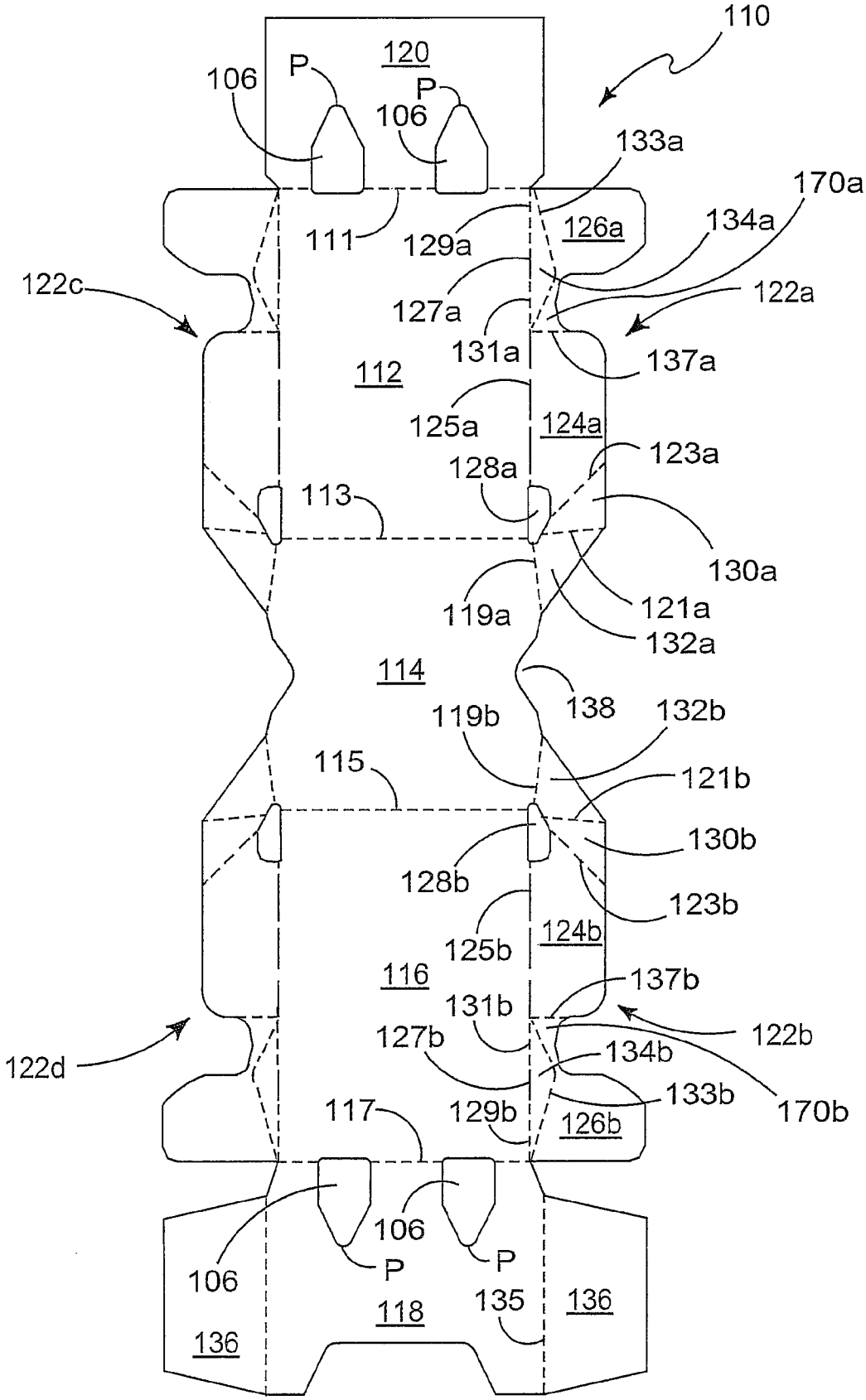
FIG. 6 shows a plan view of a blank for forming a carton according to a second embodiment of the present invention.

FIG. 6 illustrates a blank 110 according to a second embodiment of the present invention, where like parts have been designated by the same reference numeral with the prefix "1" and only the differences are described in any greater detail.

Blank 110 comprises end closure structures 122*a*, 122*b*, in which web panels 134*a*, 134*b* are defined by a "V" shaped fold line 133*a*, 133*b* the ends of which form a vertex with one of fold lines 129*a*, 129*b*, 131*a*, 131*b* respectively. A further fold line 137*a*, 137*b* extends perpendicular to fold line 125*a*, 125*b*.

End closure panels 126*a*, 126*b* comprise an upper portion 170*a*, 170*b* defined in part by fold line 137*a*, 137*b* and "V" shaped fold line 133*a*, 133*b*.

Figure 7:
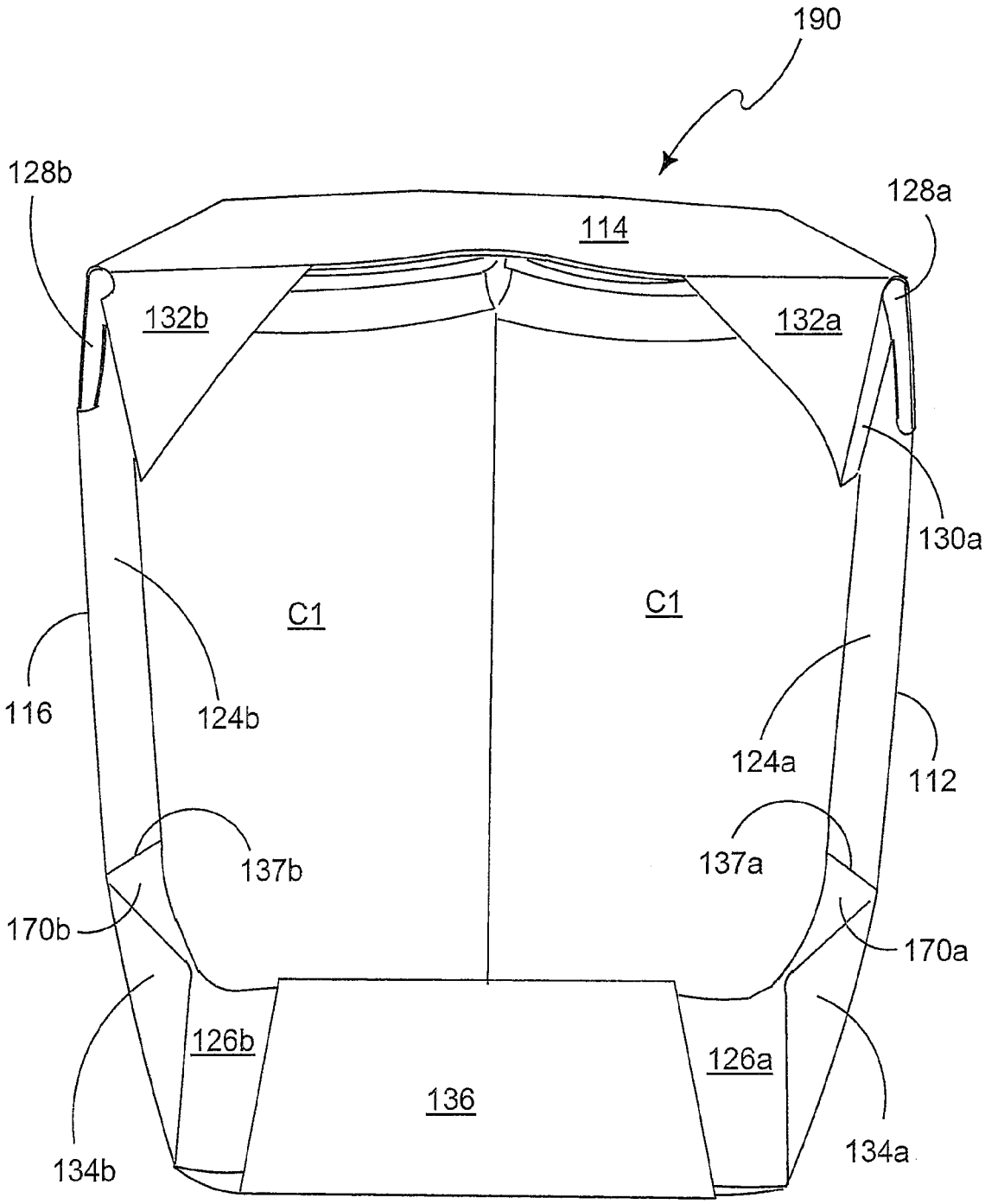
FIG. 7 illustrates a perspective view of an assembled carton according to a second embodiment of the present invention.

FIG. 7 illustrates that the arrangement of web panels 134*a*, 134*b* allows the securing panel 124*a*, 124*b* to be folded into flat face contacting relationship with a respective opposed side wall 112, 116 whilst end closure panels 126*a*, 126*b* are substantially perpendicular to the respective opposed side walls 112, 116.

It can be seen in FIG. 7 that upper portions 170*a*, 170*b* are disposed at an inclined relationship to a notional horizontal plane, in a similar manner to that of a lower region of securing panel 124*a*, 124*b* of the first embodiment. Fold line 137*a*, 137*b* facilitates the folding of the upper portion 170*a*, 170*b*.

Figure 8:
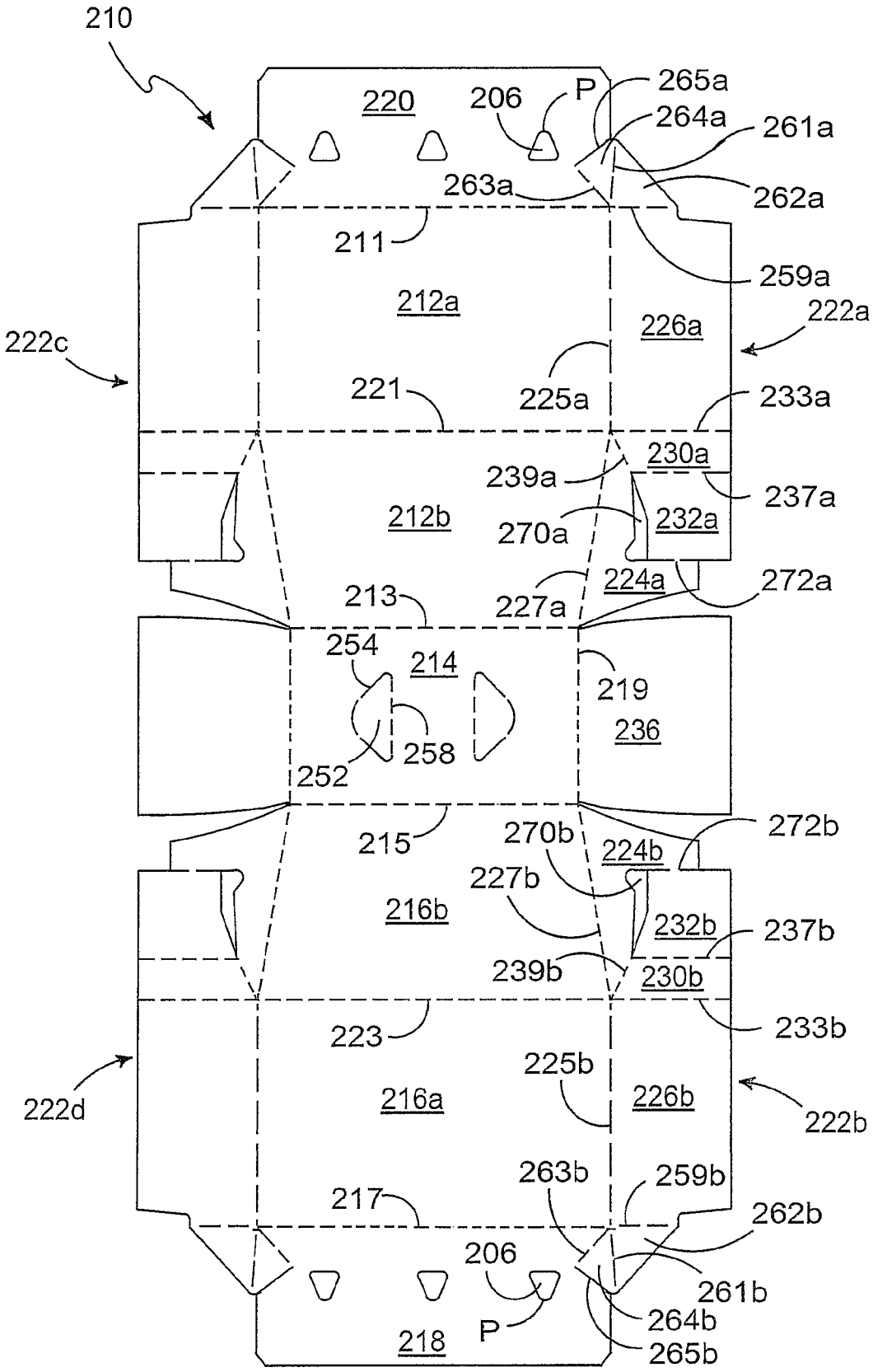
FIG. 8 illustrates a plan view of a blank according to a third embodiment of the present invention.

Turning now to FIG. 8, there is shown a blank according to a third embodiment of the present invention in which like parts have been designated with the same reference numeral with the prefix "2" and only the differences are described in detail.

FIG. 8 illustrates a blank 210 for forming a wraparound carton 290. In which opposed side panels 212, 216 comprise upper and lower panels 212*a*, 212*b*/216*a*, 216*b* respectively hinged along fold lines 221, 223.

End closure structure 222*a*, 222*b* are provided for at least partially closing the ends of the carton 290.

End closure panels 226*a*, 226*b* are hingedly connected to lower side panels 212*b*, 216*b* respectively along fold lines 225*a*, 225*b*.

A pair of gusset panels 262*a*, 262*b*; 264*a*, 264*b* hingedly interconnect end closure panels 226*a*, 226*b*, with bottom wall panels 220, 218 respectively.

First gusset panel 262*a*, 262*b* is hinged to end closure panel 226*a*, 226*b* along fold line 259*a*, 259*b* respectively and to second gusset panel 264*a*, 264*b* along fold line 261*a*, 261*b* respectively.

Second gusset panel 264*a*, 264*b* is struck at least in part from a respective one of the bottom wall panels 220, 218. Second gusset panel 264*a*, 264*b* being separated from bottom wall panel 220, 218 by cut line 265*a*, 265*b* respectively, and hinged to bottom wall panel 220, 218 along fold line 263*a*, 263*b* respectively.

Connecting panel 230*a*, 230*b* is hinged to lower end closure panel 226*a*, 226*b* along fold lines 233*a*, 233*b* respectively. Connecting panels 230*a*, 230*b* are hinged to upper end closure panels 232*a*, 232*b* along fold lines 237*a*, 237*b* respectively. Upper end closure panels 232*a*, 232*b* are connected to a securing panel 224*a*, 224*b* by a frangible connection 272*a*, 272*b*. Securing panels 224*a*, 224*b* are hinged to upper side panels 212*b*, 216*b* along fold lines 227*a*, 227*b* and also to connecting panels 230*a*, 230*b* along fold lines 239*a*, 239*b*.

An aperture 270*a*, 270*b* is struck from securing panels 224*a*, 224*b* and from upper end closure panels 232*a*, 232*b*. A top end flap 236 is coupled to each end of top panel 214 along a fold line 219.

End closure structures 222*a*, 222*b* along with top end flap 236 in combination close one end of the carton 290.

Figure 9:
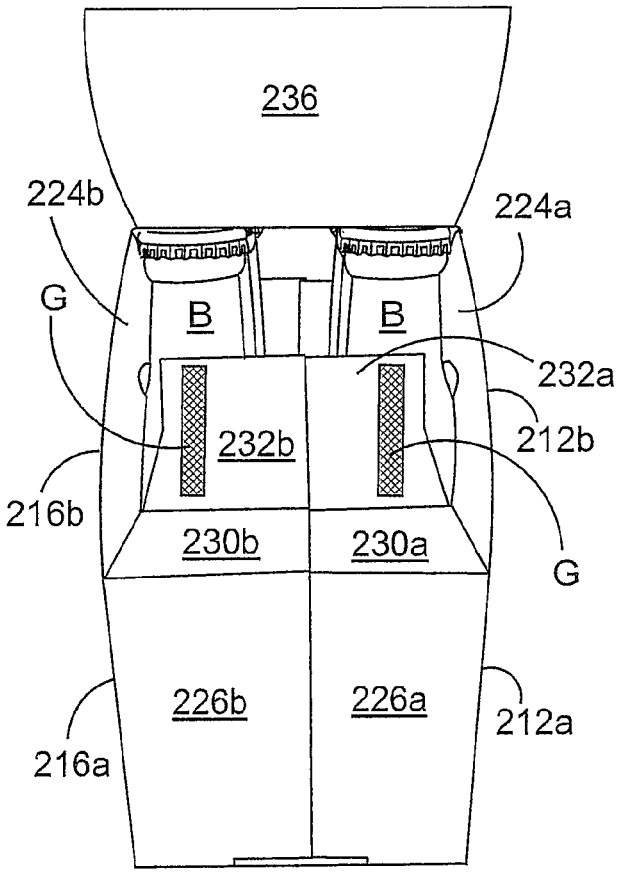
FIG. 9 shows a perspective view of an end of a carton according to the third embodiment of the present invention.
Figure 10:
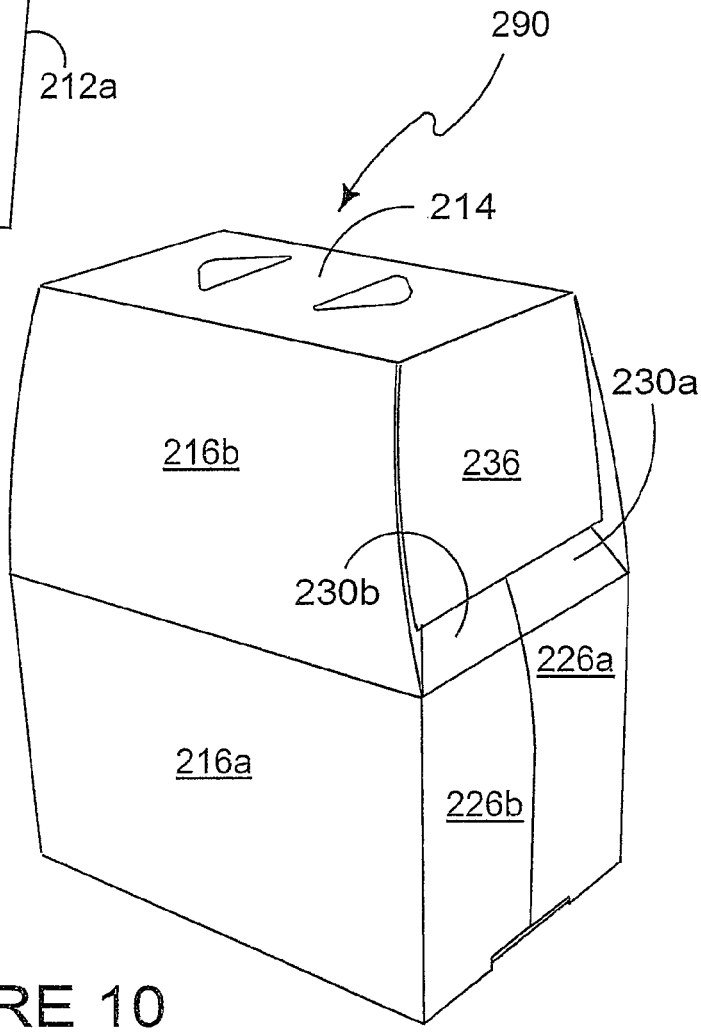
FIG. 10 shows a perspective view of an assembled carton according to the third embodiment of the present invention.

Assembly of the end closure structures 222*a*, 222*b* will now be described with reference to FIGS. 9 and 10.

The blank 210 is assembled around a group of articles B in this case bottles, into a substantially tubular structure, in a manner substantially the same as for the previous two embodiments of the invention.

The end closure structures 222*a*, 222*b* are folded to close an end of the carton 290 by folding securing panel 224*a*, 224*b* into flat face contacting relationship with a respective one of the opposed upper sidewalls 212*b*, 216*b*.

Securing panels 224*a*, 224*b* are separated from upper end closure panels 232*a*, 232*b* by breaking the frangible connection 272*a*, 272*b* therebetween. Securing panels 224*a*, 224*b* are secured between a respective one of upper side walls 212*b*, 216*b* and an adjacent article B.

As a consequence of folding securing panels 224*a*, 224*b*, upper and lower end closure panels 232*a*, 226*a*; 232*b*, 226*b* and connecting panels 230*a*, 230*b* are folded substantially perpendicularly to a respective one of side walls 212, 216 to which it is hinged, thereby substantially closing the end of the carton 290. Panels 232*a*, 230*a* and 226*a* partially overlap with panels 232*a*, 230*b* and 226*b*.

Due to the angled orientation of fold line 239*a*, 239*b* the connecting panels 230*a*, 230*b* are each disposed at an inclined angle relative to a notional horizontal plane. Whereas upper and lower end closure panels 232*a*, 232*b* and 226*a*, 226*b* are disposed in substantially vertical, albeit offset, notional planes.

Glue G is applied to upper end closure panels 232*a*, 232*b*, top end flap 236 is folded about fold line 219 into contacting relationship with upper end closure panels 232*a*, 232*b*, whereby sealing the end closure structures 222*a*, 222*b* in position.

In alternative embodiments it is envisaged that glue or other adhesive may be applied to the inside surface of top end flap 236 by an inline gluing machine or other known means.

Figure 11:
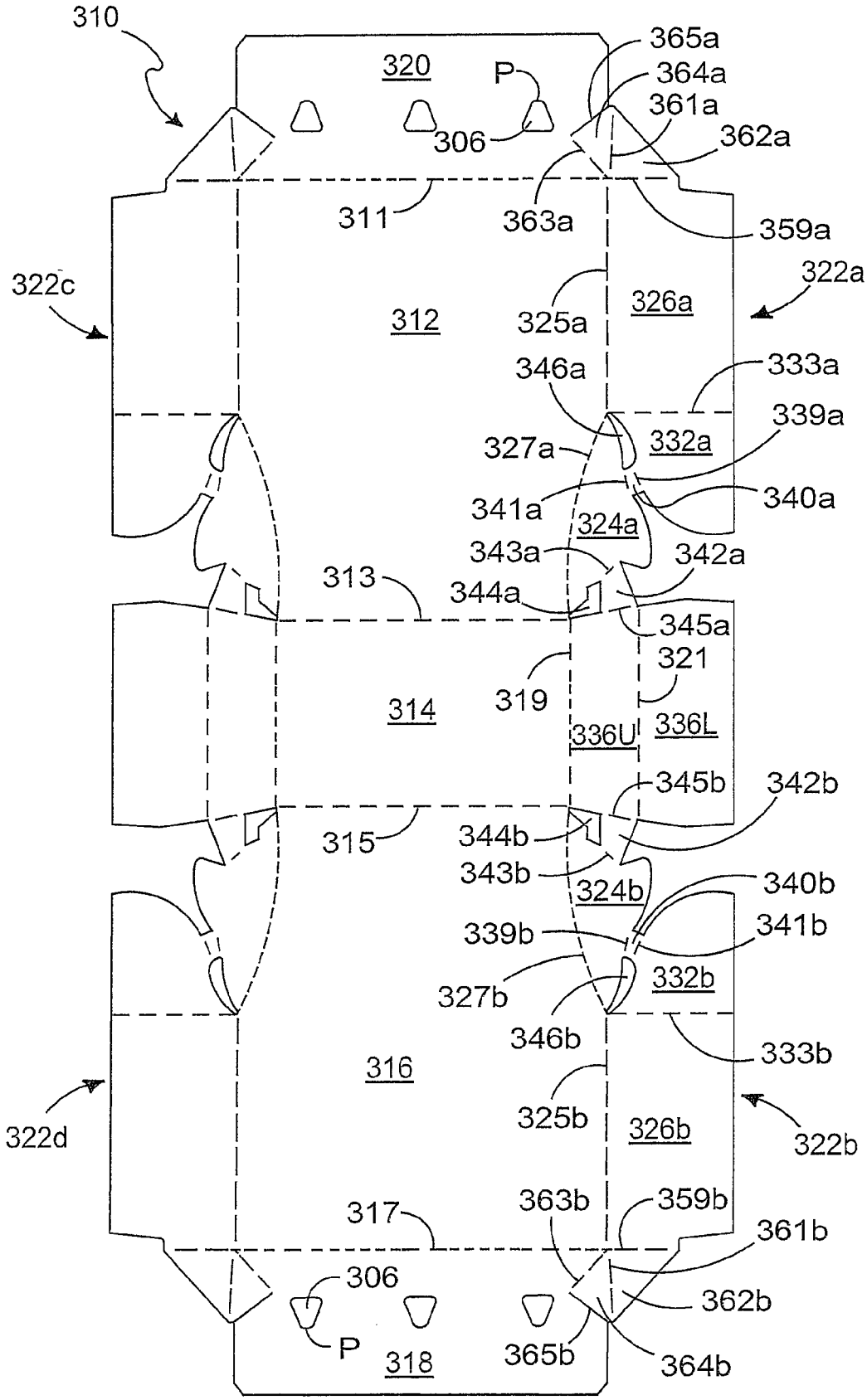
FIG. 11 shows a plan view of a blank for forming a carton according to a fourth embodiment of the present invention.
Figure 12:
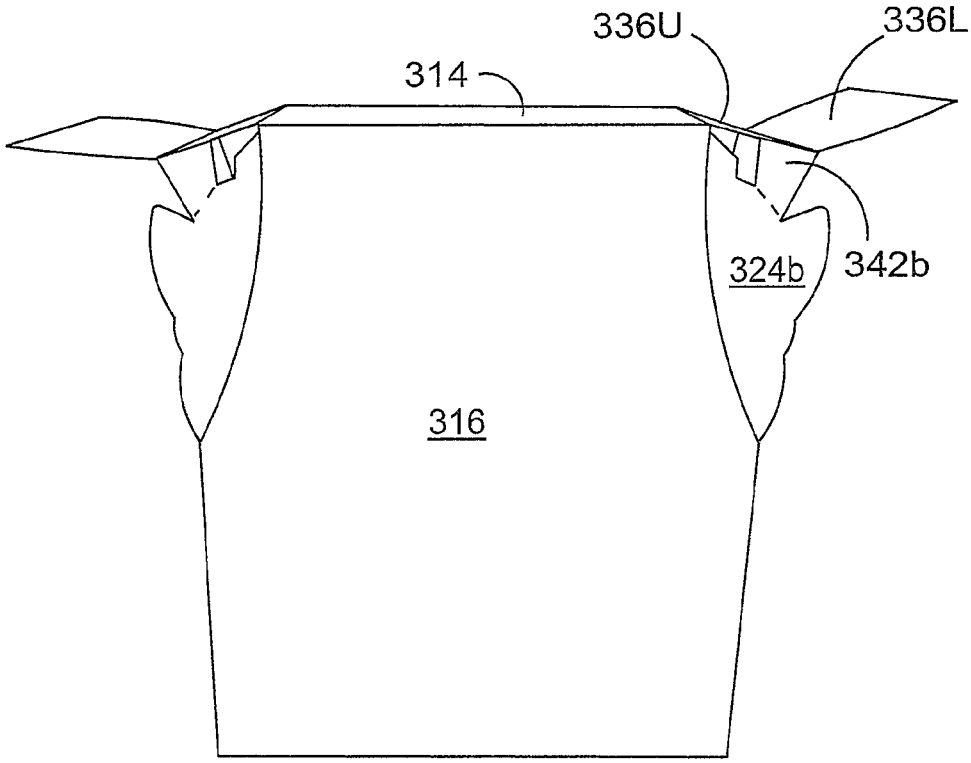
FIG. 12 shows a perspective view of a side of a carton wherein the end closure structure is partially assembled.
Figure 13:
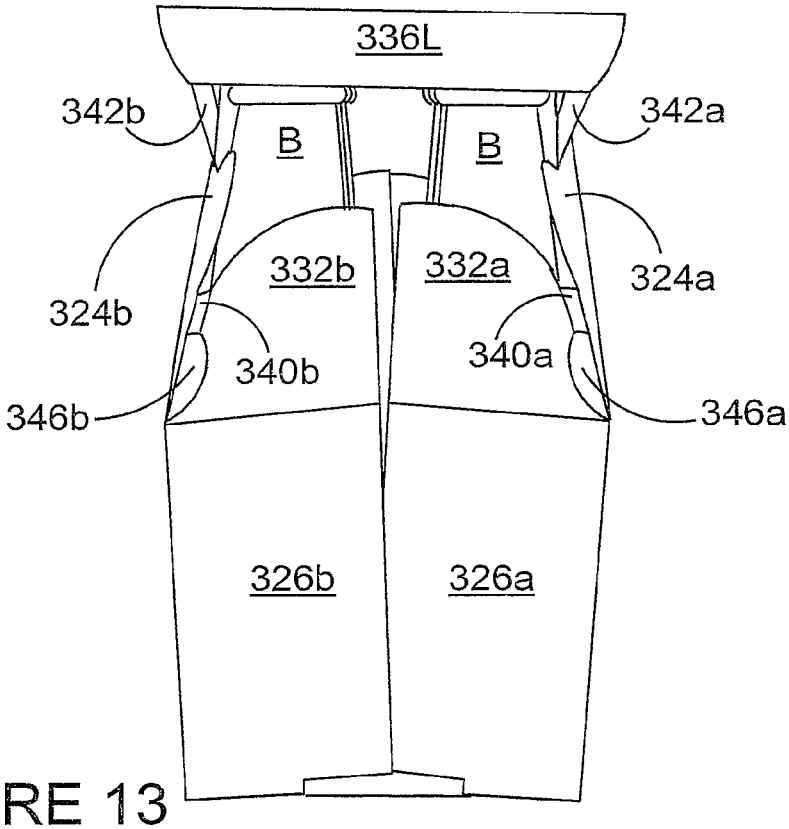
FIG. 13 shows a perspective view of an end of the carton wherein the end closure structure is partially assembled.

Turning now to FIG. 11 there is shown a blank 310 according to a fourth embodiment of the present invention, the fourth embodiment is similar in structure to the third embodiment, like parts are denoted with the same reference sign with the prefix "3", only differences will be described in any detail.

Figure 15:
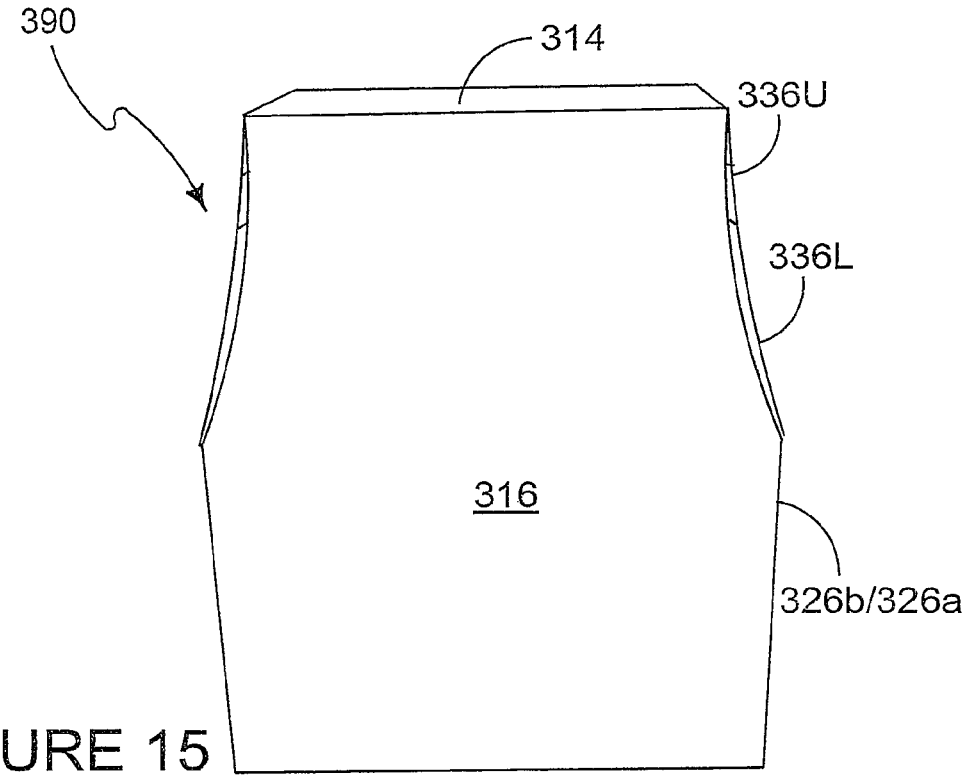
FIG. 15 illustrates a perspective view of an assembled carton according to a fourth embodiment of the present invention.

Blank 310 comprises a series of panels 312, 314, 316 318, 320 for forming walls of a wraparound carton 390 shown in FIG. 15.

Each end of the wraparound carton 390 can be closed by end closure structures 322*a*, 322*b*; 322*c*, 322*d* and a top end flap 336U, 336L.

End closure structures 322*a*, 322*b* comprise lower end closure panels 326*a*, 326*b* which are hingedly interconnected to bottom panel 318 by a pair of gusset panels 362*a*, 362*b*; 364*a*, 364*b* in a manner similar to the embodiment of FIG. 8. At an upper edge of the lower end closure panel 326*a*, 326*b* an upper end closure panel 332*a*, 332*b* is hinged along fold line 333*a*, 333*b*.

Side walls 312, 316 comprise upper portions which are tapered inwardly towards the top panel 314 by virtue of arcuate fold lines 327*a*, 327*b*. Fold lines 327*a*, 327*b* couple securing panels 324*a*, 324*b* to side walls 312, 316. Each of securing panels 324*a*, 324*b* are coupled to a respective one of upper end closure panels 332*a*, 332*b* by a connecting panel 340*a*, 340*b* respectively.

It will be appreciated that the securing panels 324*a* and the upper end closure panels 332*a* are each struck from material, in the blank form, provided between the lower end closure panel 326*a*, the side wall panel 312 and the top end flap 336U, 336L, without increasing the dimensions of the "footprint" of the carton blank, in this way the quantity of paperboard required is minimised.

Connecting panels 340*a*, 340*b* are defined in part by cut lines 339*a*, 339*b* and 341*a*, 341*b*. An aperture 346*a* struck from securing panels 324*a*, 324*b* and from upper end closure panels 332*a*, 332*b* separates the securing panels 324*a*, 324*b* from upper end closure panels 332*a*, 332*b*.

Each of securing panels 324*a*, 324*b* are coupled to top end flap 336U/336L by a web panel 342*a*, 342*b* respectively. Web panels 342*a*, 342*b* are defined in part by cut lines 343*a*, 343*b* and 345*a*, 345*b*.

Top end flap 336 comprises upper and lower portions 336U and 336L. Web panels 342*a*, 342*b* are hinged to upper portion 336U of the top end flap 336U/336L. Upper and lower portions 336U and 336L are hinged by fold line 321.

Figure 14:
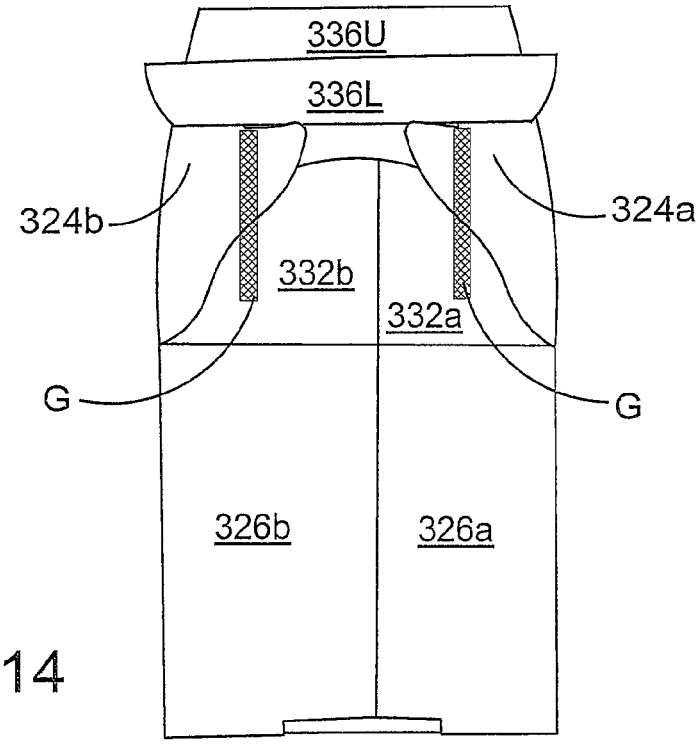
FIG. 14 illustrates a perspective view of an end of a carton in a further developed state of assembly.

Turning now to the construction of the carton 390 and in particular the process of assembling the end closure structures 322*a*, 322*b*, as shown in FIGS. 14 and 15; lower end closure panels 326*a*, 326*b* are folded inwardly to partially close an end of the carton 390 and as a consequence, upper end closure panels 332*a*, 332*b* are automatically folded inwardly.

Securing panels 324*a*, 324*b* are then folded inwardly at least partially as a consequence of the coupling to upper end closure panels 332*a*, 332*b* by connecting panels 340*b*, 340*b*. In turn the coupling between upper end closure panel 332*a*, 332*b*, via web panel 342*a*, 342*b*, and securing panel 324*a*, 324*b* provides that the securing panels 324*a*, 324*b* are at least partially folded inwardly about fold lines 327*a*, 327*b*. This in turn draws the top end flap 336U/336L downwardly about fold line 319.

Securing panels 324*a*, 324*b* and top end flap 336U/336L can be folded into face contacting relationship by folding the top end flap 336U/336L downwardly or by folding securing panels 324*a*, 324*b* inwardly.

Separation of top end flap 336U/336L into upper and lower portions 336U and 336L allows the lower portion 336L to remain, or be, folded outwardly whilst glue or other adhesive is applied to the securing panels 324*a*, 324*b* and upper end closure panels 332*a*, 332*b* prior to securing lower portion 336L onto them and thereby securely closing the carton 390. In this way the end closure structure 322*a*, 322*b*, 322*c*, 322*d* allows each end of the carton 390 to be fully enclosed in a carton 390 having a tapered upper portion, in particular a gable end style carton where the carton comprises a top panel which is smaller than the base panel, such cartons are especially useful for packaging articles which are tapered for example bottles having a neck portion which is of smaller dimension, for example diameter, than the base portion, similarly this is advantage is also provided by the embodiment of FIGS. 8 to 10.

It is envisaged that modification may be made in the foregoing without departing from the scope of the invention.

It should be appreciated that as used herein, directive references such as "top", "bottom", "end", "side", "upper" and "lower" do not limit the respective panels to such orientation, but merely serve to distinguish these panels from one another. It should be further appreciated that any reference to hinged or foldable connections should not be construed as necessarily referring to a single fold line only, indeed it is envisaged that hinged connection can be formed from one or more of the following, a score line, a frangible line or a fold line, without departing from the scope of the invention.

The invention claimed is:

1. A carton for packaging a plurality of articles, comprising top and bottom panels connected together by spaced side wall panels to form a tubular structure and a set of end panels for at least partially closing each end of the tubular structure, the set of end panels comprising:

a pair of upper end closure panels which are not directly connected to the spaced side wall panels;

a pair of lower end closure panels hinged to respective lower portions of the side wall panels respectively;

a pair of securing panels hingedly connected to respective upper portions of the side wall panels respectively; and a top end flap hingedly connected to the top panel and secured to the upper end closure panels in a face-contacting relationship, wherein the upper end closure panels are hingedly connected respectively to the securing panels by respective connecting panels, and wherein the upper end closure panels are coupled to the lower end closure panels respectively, and wherein the upper end panels are coupled respectively to the lower end closure panels by the respective connecting panels.

2. The carton according to claim 1, wherein the upper end closure panels are further connected respectively to the securing panels by respective frangible connections.

3. The carton according to claim 1, wherein the top end flap is coupled to each of the securing panels by web panels.

4. The carton according to claim 1, wherein the top end flap comprises upper and lower portions hingedly connected together by a fold line to facilitate application of adhesive to the upper end closure panels.

5. The carton according to claim 1, wherein the respective connecting panels are disposed substantially perpendicularly to the spaced side walls, to thereby partially close each end of the carton.

6. A blank for forming a carton, the blank comprising an elongate section including a top panel, a bottom panel and a pair of side wall panels, and a set of end panels hingedly connected to the elongate section along at least one of opposed longitudinal edges of the elongate section, the set of end panels comprising:

a lower end closure panel hingedly connected to a lower portion of at least one of the side wall panels;

a securing panel hingedly connected to an upper portion of the at least one side wall panel;

an upper end closure panel coupled to the lower end closure panel, but not directly connected to the pair of side wall panels; and a top end flap hingedly connected to the top panel and configured to be secured to the upper end closure panel in a face-contacting relationship in the formed carton, wherein the upper end closure panel and the securing panel are each struck from material provided in an area defined by boundaries of the lower end closure panel, the at least one side wall-panel and the top end flap, and wherein the upper end closure panel is coupled to the lower end closure panel by a connecting panel.

7. The blank according to claim 6, wherein the upper end closure panel is coupled to the securing panel by a frangible connection.

8. The blank according to claim 6, wherein the top end flap is coupled to the securing panel by a web panel.

9. The blank according to claim 8, wherein the top end flap comprises upper and lower portions hingedly connected together by a fold line to facilitate application of adhesive to the upper end closure panel.

10. A carton for packaging a plurality of articles, comprising top and bottom panels connected together by spaced side wall panels to form a tubular structure and a set of end panels for at least partially closing each end of the tubular structure, the set of end panels comprising;

a pair of upper end closure panels which are not directly connected to the spaced side wall panels;

a pair of lower end closure panels hinged to respective lower portions of the side wall panels respectively;

a pair of securing panels hingedly connected to respective upper portions of the side wall panels respectively; and a top end flap hingedly connected to the top panel and secured to the upper end closure panels in a face-contacting relationship, wherein the upper end closure panels are hingedly connected respectively to the securing panels by respective connecting panels, and wherein the upper end closure panels are coupled to the lower end closure panels respectively, and wherein the securing panels are folded into the tubular structure to be in flat face contacting relationship with the respective upper portions of the side wall panels respectively.

* * * * *